US009091044B2

(12) United States Patent
Choi

(10) Patent No.: US 9,091,044 B2
(45) Date of Patent: Jul. 28, 2015

(54) APPARATUS AND METHOD FOR CONTROLLING AUTOMATIC OPERATION OF WORKING UNIT OF WHEEL LOADER

(75) Inventor: Ki Hong Choi, Gyeonggi-do (KR)

(73) Assignee: Doosan Infracore Co., Ltd., Incheon (KR)

( * ) Notice: Subject to any disclaimer, the term of this patent is extended or adjusted under 35 U.S.C. 154(b) by 0 days.

(21) Appl. No.: 13/392,316

(22) PCT Filed: Aug. 23, 2010

(86) PCT No.: PCT/KR2010/005585

§ 371 (c)(1),
(2), (4) Date: Feb. 24, 2012

(87) PCT Pub. No.: WO2011/025197

PCT Pub. Date: Mar. 3, 2011

(65) Prior Publication Data

US 2012/0158234 A1 Jun. 21, 2012

(30) Foreign Application Priority Data

Aug. 24, 2009 (KR) ..... 10-2009-0078009

(51) Int. Cl.
*E02F 9/20* (2006.01)
*E02F 3/43* (2006.01)

(52) U.S. Cl.
CPC ..... *E02F 3/434* (2013.01)

(58) Field of Classification Search
CPC ..... E02F 3/434
USPC ..... 701/23, 50
See application file for complete search history.

(56) References Cited

U.S. PATENT DOCUMENTS

2002/0082842 A1* 6/2002 Viaud ..... 704/275
2006/0184302 A1* 8/2006 Ikari ..... 701/50

FOREIGN PATENT DOCUMENTS

KR 10-1994-0008351 B1 9/1994
KR 20-1999-0026169 U 7/1999
KR 10-2001-0057395 A 7/2001
KR 10-2009-0131085 A 12/2009

OTHER PUBLICATIONS

Search Report dated Apr. 26, 2011, written in Korean with English translation attached for International Application No. PCT/KR2010/005585, filed Aug. 23, 2010, pp. 1-5.

* cited by examiner

*Primary Examiner* — John Q Nguyen
*Assistant Examiner* — Rodney P King
(74) *Attorney, Agent, or Firm* — John D. Veldhuis-Kroeze; Westman, Champlin & Koehler, P.A.

(57) ABSTRACT

The method includes: verifying a working state of the wheel loader through detection of a bucket position and a driving state and examining whether the verified working state is an excavation completed state; examining whether a current position of a driving direction operating lever is a backward-movement position when the verified working state is the excavation completed state as a result of the examination; and automatically moving up a position of a boom up to a predetermined position together with backward driving of the wheel loader depending on whether an automatic operation mode is set when the driving direction operating lever position is the backward-movement position.

4 Claims, 3 Drawing Sheets

APPARATUS AND METHOD FOR CONTROLLING AUTOMATIC OPERATION OF WORKING UNIT OF WHEEL LOADER

This Application is a Section 371 National Stage Application of International Application No. PCT/KR2010/005585, filed Aug. 23, 2010 and published, not in English, as W02011/025197 on Mar. 3, 2011.

FIELD OF THE DISCLOSURE

The present disclosure relates to an apparatus and a method for controlling an automatic operation of a working unit of a wheel loader, and more particularly, to an apparatus and a method for controlling an automatic operation of a working unit of a wheel loader that controls the automatic operation by estimating a subsequent operation according to a current condition of the working unit.

BACKGROUND OF THE DISCLOSURE

In general, a wheel loader is constituted by a working unit as a means for a work including a bucket and a boom and a driving device and a driver of the wheel loader directly operates the driving device and the working unit to perform a principal work of the wheel loader.

In this case, the principal work of the wheel loader represents a work of performing an excavation work in a worksite and thereafter, moving the excavated load to a place where the load is stacked.

The driver operates the driving device to move the wheel loader to the vicinity of the load in order to perform the wheel loader work and operates the working unit in a loadable pattern (return to dig). Thereafter, the driver operates the driving device to move forward to load the load into the bucket and operates the working unit in a pattern (Max Crowd) capable of moving the load and thereafter, operates the driving device to move backward and separates the driving device from the load. In addition, the driver operates the driving device to move to the vicinity of a place to which the load will be stacked and operates the working unit to separate the load from the wheel loader.

In recent years, there is a trend that a technology of estimating a subsequent working state by judging a current working state and performing an automatic operation in the estimated working state has been developed in order to provide convenience in which the driver can conveniently operate an industrial vehicle such as a wheel loader or an excavator when operating the industrial vehicle.

As a result, there is required the technology for estimating the working state and performing the automatic operation in the estimated working state in order to provide convenience to a driver even when the driver operates the wheel loader.

The discussion above is merely provided for general background information and is not intended to be used as an aid in determining the scope of the claimed subject matter.

SUMMARY

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

The present disclosure provides an apparatus and a method for controlling an automatic operation of a working unit of a wheel loader in which the apparatus for controlling the automatic operation of the working unit of the wheel loader estimates and controls a subsequent operation of the working unit which a driver will operate based on a driving operation of the driver of the wheel loader and a current state of the working unit to provide convenience to the driver.

In order to achieve the above object, a method for controlling an automatic operation of a working unit of a wheel loader includes: verifying a working state of the wheel loader through detection of a bucket position and a driving state and examining whether the verified working state is an excavation completed state; examining whether a current position of a driving direction operating lever is a backward-movement position when the verified working state is the excavation completed state as a result of the examination; and automatically moving up a position of a boom up to a predetermined position together with backward driving of the wheel loader depending on whether an automatic operation mode is set when the driving direction operating lever position is the backward-movement position.

The examining whether the verified working state is the excavation completed state may include: examining whether the driving direction operating lever position is a forward-movement position; examining whether the bucket position is operated in a loadable pattern when the position of the driving direction operating lever is the forward-movement position; recognizing whether an operation for an excavation work is currently underway as a current working state when the bucket position is operated in the loadable pattern and examining whether the bucket position is full crowd; and verifying whether the working state is the excavation completed state according to whether the current bucket position is the full crowd.

The method may further include: examining whether the current position of the driving direction operating lever is the backward-movement position; recognizing that the current working state is the excavation completed state when the current bucket position is the full crowd after the verification process is performed; and examining whether a current position of the driving direction operating lever is the backward-movement position.

The predetermined position of automatically moving up the position of the boom may be the predetermined position of the boom in order to perform a detent function which is a function to automatically stop upward and downward movements of the boom at a predetermined height.

Further, an apparatus for controlling an automatic operation of a working unit of a wheel loader includes: an automatic operation selecting switch for selecting an automatic operation mode; a driving direction operating lever detecting a driving direction command; a working unit angle sensor detecting current positional states of a boom and a bucket; a working unit controlling unit controlling motions by supplying hydraulic pressure to a boom and a bucket cylinder; a driving device controlling unit controlling forward movement or backward movement of the wheel loader; and a control unit detecting a bucket position by using the working unit angle sensor, verifying a working state of the wheel loader by using the driving direction operating lever to detect a driving state, examining whether a current driving direction operating lever position is a backward-movement position through the driving direction operating lever when the verified working state is an excavation completed state, and commanding to automatically move up a position of the boom up to a predetermined position with the working unit controlling unit together with backward driving of the wheel loader depending on whether the automatic operation mode is set when the driving direction operating lever position is the backward-movement position.

The control unit may examine whether the driving direction operating lever position is a forward-movement position, recognize that an operation for an excavation work is currently underway, as a current working state, when a bucket position is operated in a loadable pattern after examining whether the bucket position is operated in the loadable pattern by using the working unit angle sensor when the driving direction operating lever position is the forward-movement position, and recognize that the working state is the excavation completed state depending on whether the current bucket position is full crowd after examining whether the bucket position is the full crowd by using the working unit angle sensor.

According to the present disclosure, some of the processes which a driver of a wheel loader simply repeats for a work are omitted to improve the driver' s convenience, and as a result, productivity in a worksite adopting the wheel loader can be increased.

DETAILED DESCRIPTION

Figure 1:
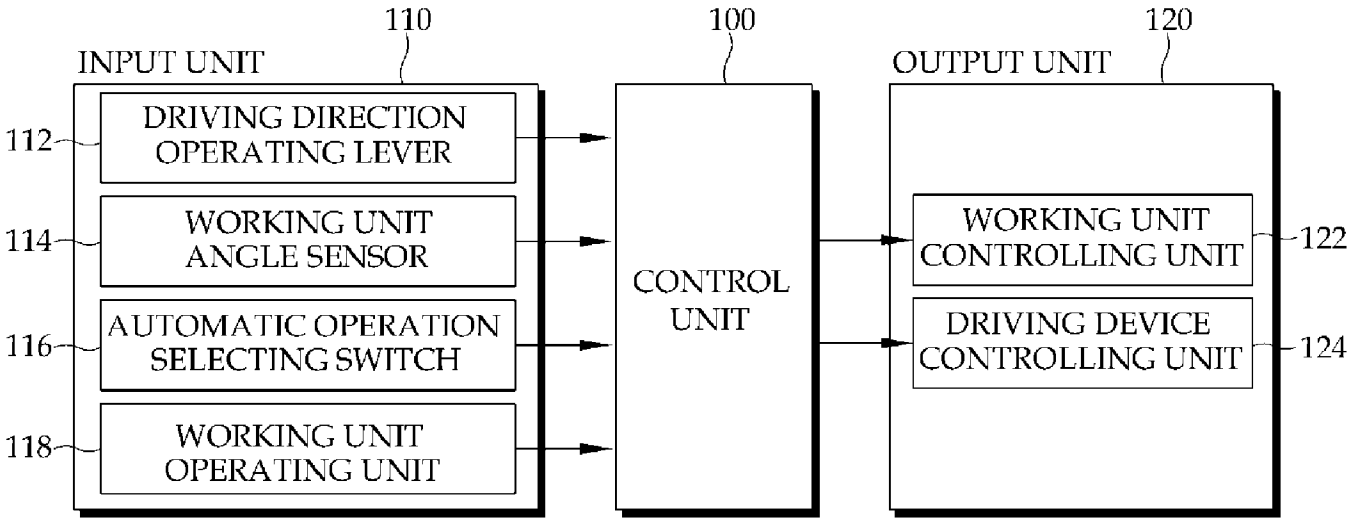
FIG. 1 is a diagram showing an internal configuration of an apparatus for controlling an automatic operation of a working unit of a wheel loader according to an exemplary embodiment of the present disclosure.

Description of Main Reference Numerals of Drawings

100: Control unit
110: Input unit
112: Driving direction operating lever
114: Working unit angle sensor
116: Automatic operation selecting switch
118: Working unit operating unit
120: Output unit
122: Working unit controlling unit (MCV)
124: Driving device controlling unit (TCU)

Hereinafter, exemplary embodiments of the present disclosure will be described in detail with reference to the accompanying drawings. It should be noted that the same components refer to the same reference numerals anywhere as possible in the drawings. In the following description, specific detailed matters will be described and are provided to the more overall understanding of the present disclosure. Further, in describing the present disclosure, well-known functions or constructions will not be described in detail since they may unnecessarily obscure the understanding of the present disclosure.

In general, in the case of a wheel loader, most of the drivers operate a working unit in a pattern (Max Crowd) to move a load at all times before moving the wheel loader backward in order to move the load loaded in a bucket after an excavation work is completed at the time of performing the work.

In the present disclosure, an action of operating the working unit in the pattern (Max Crowd) to move a load is automatically operated before moving the wheel loader backward in order to move the load, thereby providing convenience to the driver.

To this end, an apparatus for controlling an automatic operation of a working unit of a wheel loader needs to be able to monitor a current state and a driving state of the working unit and judge a current working state based thereon. Further, a subsequent working state is estimated through the presently judged working state to directly control the working unit.

First, referring to FIG. 1, an apparatus for controlling an automatic operation of a working unit of a wheel loader according to an exemplary embodiment of the present disclosure will be described.

The apparatus for controlling an automatic operation of a working unit of a wheel loader according to the exemplary embodiment of the present disclosure includes an input unit 110, a control unit 100, and an output unit 120. The input unit 110 includes a driving direction operating lever 112, a working unit angle sensor 114, an automatic operation selecting switch 116, and a working unit operating unit 118. The output unit 120 including a working unit controlling unit (MCV) 122 and a driving device controlling unit (TCU) 124.

The driving direction operating lever 112 detects a driving direction command of the driver.

The working unit angle sensor 114 detects current positional states of a boom and a bucket. The working unit angle sensor 114 includes a boom angle sensor and a bucket angle sensor. The boom angle sensor as a sensor for sensing an attitude of the boom outputs an angle sensing signal of the boom. The bucket angle sensor as a sensor for sensing an attitude of the bucket outputs an angle sensing signal of the bucket.

The automatic operation selecting switch 116 detects a driver' s automatic operation selecting will. The automatic operation selecting switch 116 according to the exemplary embodiment of the present disclosure as a switch for selecting an automatic operating mode outputs a switch on/off signal to the control unit 100 according to a switch operation of a worker.

The working unit operating unit 118 detects a driver' s direct control will for the working unit during the automatic operation. The working unit operating unit 118 may include a boom joystick and a bucket joystick and the boom joystick is an input device for moving up and down the boom and the bucket joystick is an input device for dumping and crowding the bucket.

The working unit controlling unit (MCV) 122 controls a motion of the working unit by supplying hydraulic pressure to a cylinder of the working unit. The working unit controlling unit (MCV) 122 may include a boom control valve and a bucket control valve and valve opening areas of the boom control valve and the bucket control valve are controlled proportionally according to current applied from the control unit 100. Further, the boom control valve controls upward movement and downward movement of the boom and the bucket control valve controls crowding and dumping of the bucket.

The driving device controlling unit (TCU) 124 controls move-forward movement or backward movement which is the driving direction of the wheel loader.

The control unit 100 judges a current working state of the wheel loader based on the working unit angle sensor 114 and the driving direction operating lever 112. Thereafter, the control unit 100 controls the working unit through a working state judgment result and by detecting whether the backward movement is operated.

In this case, the current working state is an excavation completed state by recognizing that an automatic operating mode is selected when the automatic operation selecting switch 116 is in an on state and thereafter, the control unit 100 automatically controls the boom to move up to a position of a detent with the working unit controlling unit 122 according to the detection of whether the move-backward is operated. Herein, the detent position refers to a predetermined height of the boom in order to perform a detent function. In this case, the detent function is a function to automatically stop the upward movement and the downward movement of the boom at a predetermined height.

However, when the automatic operation selecting switch 116 is in an off state, the control unit 100 controls the working unit controlling unit 122 or the driving device controlling unit 124 according to a driver's driving or work performing command by recognizing a general manual driving mode.

A control operation of the control unit 100 will be described in detail with reference to FIGS. 2 and 3.

Figure 2:
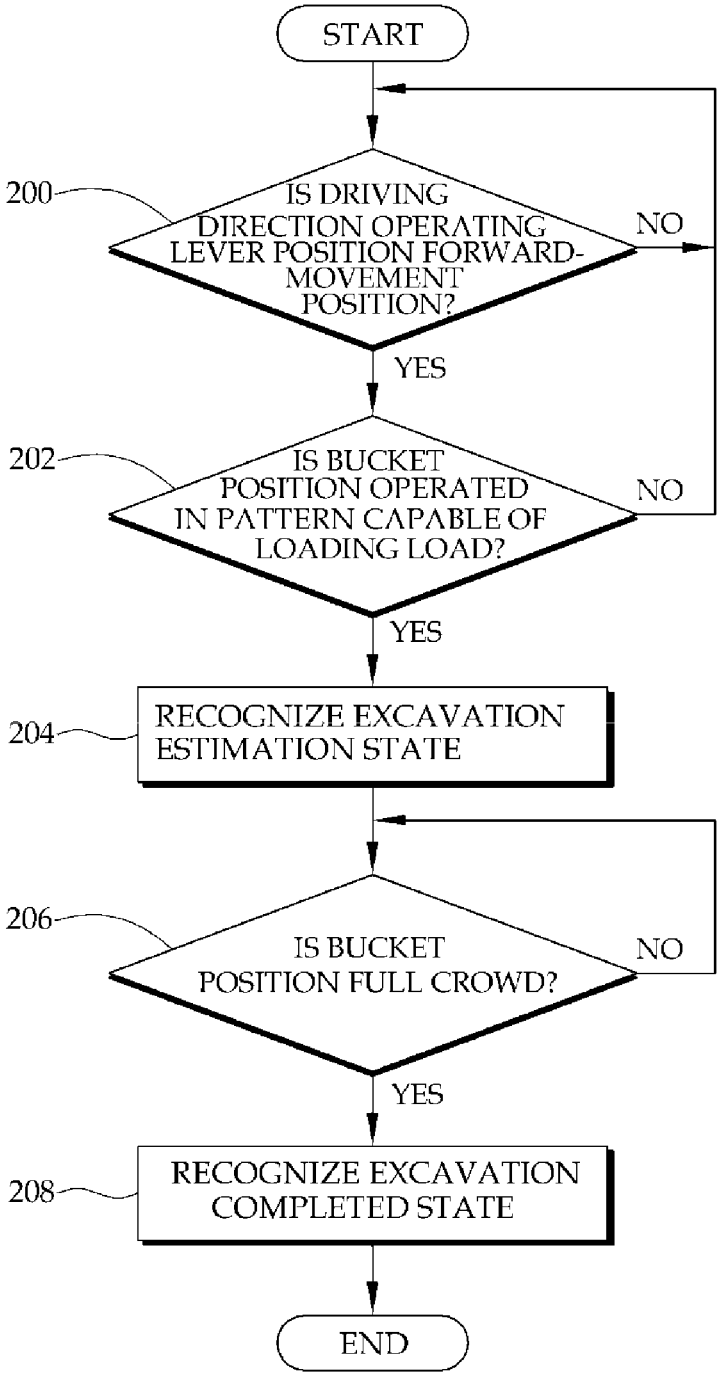
FIG. 2 is a flowchart showing a process of monitoring a working state in the apparatus for controlling an automatic operation of a working unit of a wheel loader according to an exemplary embodiment of the present disclosure.

FIG. 2 is a flowchart showing a process of monitoring a working state in the apparatus for controlling an automatic operation of a working unit of a wheel loader.

At step 200, the control unit 100 examines whether the position of the driving direction operating lever is a forward-movement position through the driving direction operating lever 112. That is, it is examined whether a current state is a state in which a vehicle moves.

If the position of the driving direction operating lever is the forward-movement position, the process proceeds to step 202 and the control unit 100 examines whether a bucket position is operated in a pattern capable of loading the load through the working unit angle sensor 114. However, if the position of the driving direction operating lever is not the forward-movement position, the process proceeds to step 200.

Meanwhile, as an examination result at step 202, when the bucket position is operated in the pattern, capable of loading the load, the process proceeds to step 204 and if not, the process proceeds to step 200.

At step 204, the control unit 100 recognizes an excavation estimating state as the bucket position is operated in the loadable pattern after the position of the driving direction operating lever is in the forward-movement position state. That is, the control unit 100 recognizes that the operation for the excavation work is currently underway.

Thereafter, the process proceeds to step 206 and the control unit 100 examines whether the bucket position is in a full crowd state through the working unit angle sensor 114.

As an examination result of step 206, if the bucket position is in the full crowd state, the control unit 100 recognizes the excavation completed state at step 208. That is, when the bucket position is in the full crowd state in the examination at step 206, the load is loaded into the bucket by operating forward movement to recognize that the excavation work is completed.

When the current state becomes the state in which the excavation work is completed as described above, the process for controlling the automatic operation is performed.

The process of controlling the automatic operation will be described with reference to FIG. 3.

Figure 3:
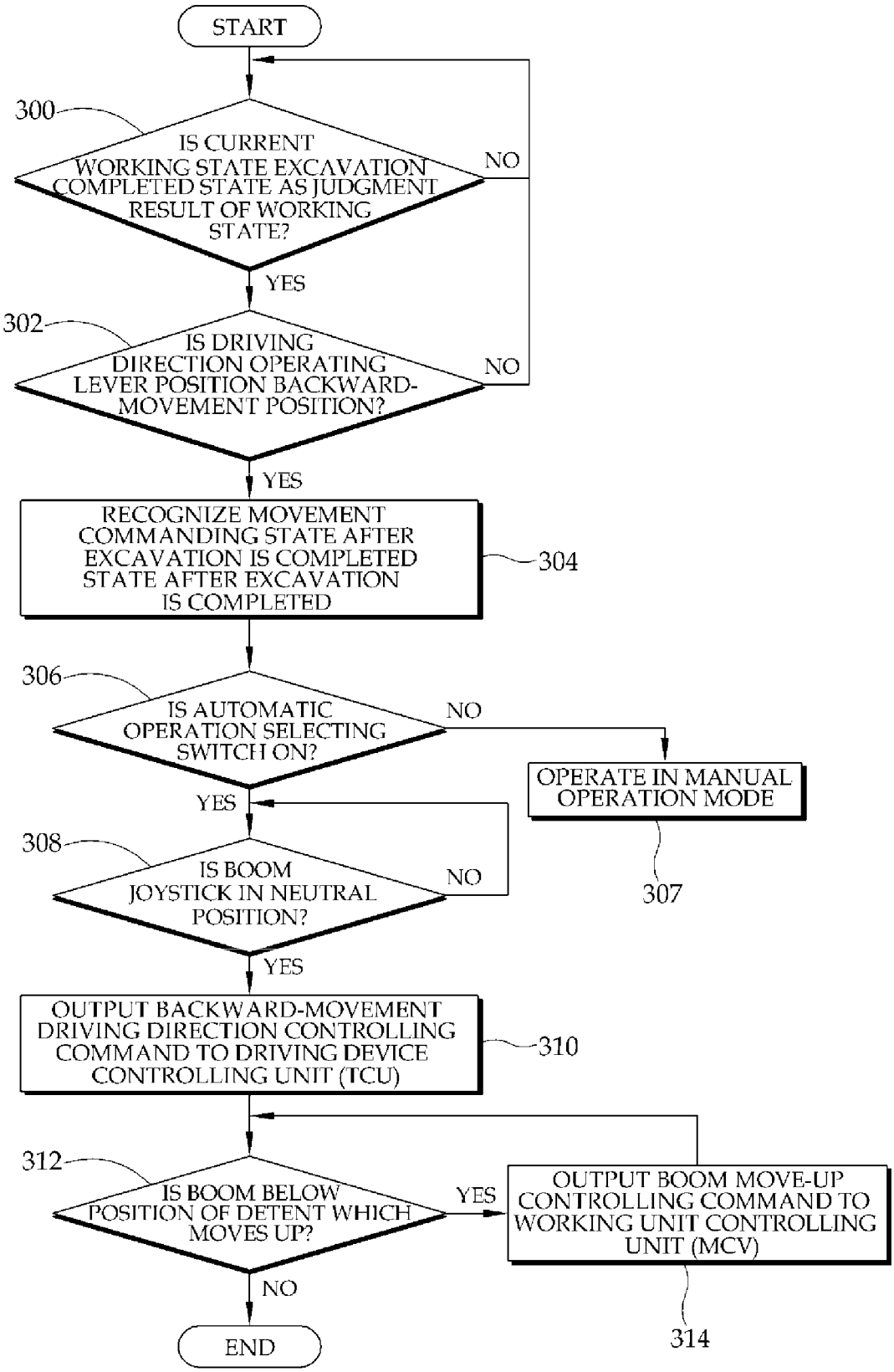
FIG. 3 is a flowchart showing a process for controlling an automatic operation according to an exemplary embodiment of the present disclosure.

Referring to FIG. 3, the control unit 100 examines whether the excavation work is completed as a judgment result of the working state at step 300.

If the current working state becomes the state in which the excavation work is completed, the process proceeds to step 302 to examine whether the position of the driving direction operating lever is the backward-movement position through the driving direction operating lever 112.

When the position of the driving direction operating lever is the backward-movement position as an examination result of step 302, the process proceeds to step 304 and the control unit 100 recognizes that the current state is an excavation completion movement instructing state. That is, the control unit 100 recognizes that the current state is a backward movement state in which the excavation work is completed to move the load.

Thereafter, the control unit 100 examines whether the automatic operation selecting switch 116 is on at step 306. That is, it is examined whether the driver selects an automatic operation mode.

If the automatic operation selecting switch 116 is on, the process proceeds to step 308 and if the automatic operation selecting switch 116 is off, the process proceeds to step 307 to operate in a manual operation mode. In this case, the manual operation mode is a mode to control the working unit controlling unit 122 or the driving device controlling unit 124 according to the driver' s driving or work performing command.

Further, the automatic operation mode is a mode to estimate a subsequent working state by judging the current working state based on the current state and the driving state and automatically control the estimated working state. The automatic operation mode in the exemplary embodiment of the present disclosure is a mode to automatically control an operation of moving up the boom to the detent position in the case of backward movement in the excavation completed state.

Meanwhile, if the automatic operation selecting switch 116 is on as the examination result of step 360, the control unit 100 examines whether the boom joystick is in a neutral position through the working unit operating unit 118 at step 308 which is performed.

If the boom joystick is in the neutral position, the process proceeds to step 310 and the control unit 110 outputs a backward movement driving direction controlling command to the driving device controlling unit (TCU) 124. The driving device controlling unit (TCU) 124 receiving the backward movement driving direction controlling command controls backward movement of the wheel loader.

Thereafter, at step 312, the control unit 100 examines whether the boom is below the position of the detent which moves up. In this case, the detent position represents a predetermined position of the boom for the detent function of the wheel loader.

When the boom is below the position of the detent which moves up as the examination result of step 312, the process proceeds to step 314 and the control unit 100 outputs a boom upward movement controlling command to the working unit controlling unit (MCV) 122. Then, the working unit controlling unit (MCV) 122 moves up the boom up to the detent position.

That is, in the automatic operation mode, when the completion of the excavation is detected by monitoring the current state and thereafter, the backward movement command is given, the working unit controlling unit (MCV) automatically moves up the boom up to the detent position while moving backward.

Therefore, the driver can automatically operate a separate working unit without performing the operation of moving up the boom which is in the pattern capable of moving the load, thereby improving the driver' s convenience.

As described above, although certain exemplary embodiments of the present disclosure have been described in detail, it is to be understood by those skilled in the art that the spirit and scope of the present disclosure are not limited to the certain exemplary embodiments, but are intended to cover various modifications and changes without departing from the gist.

Accordingly, since the above-mentioned exemplary embodiments are provided to inform those skilled in the art of the scope of the present disclosure, it should be understood that they are exemplary in all aspects and not limited and the present disclosure is just defined by the scope of the appended claims.

Although the present invention has been described with reference to disclosed embodiments, workers skilled in the art will recognize that changes may be made in form and detail without departing from the spirit and scope of the disclosure. The present disclosure can be applied to a wheel loader for providing convenience to a driver.

The invention claimed is:

1. A method for controlling an automatic operation of a working unit of a wheel loader, comprising:

verifying a current working state of the wheel loader through detection of a bucket position and a driving state and examining whether the verified current working state is an excavation completed state;

examining whether a current position of a driving direction operating lever is a backward-movement position when the verified working state is the excavation completed state as a result of the examination; and triggering an auto detent function to automatically move a position of a boom up to a predetermined position when both the current working state is an excavation completed state and the current position of the driving direction operating lever is the backward movement position, wherein the predetermined position is the predetermined position of the boom in order to perform the detent function which is a function to automatically stop upward and downward movements of the boom at a predetermined height, together with backward driving of the wheel loader depending on whether an automatic operation mode is set when the driving direction operating lever position is the backward-movement position;

wherein the examining whether the verified working state is the excavation completed state includes: examining whether the driving direction operating lever position is a forward-movement position; examining whether the bucket is operated in a loadable pattern when the driving direction operating lever position is the forward-movement position; recognizing whether an operation for an excavation work is currently underway as a current working state when the bucket is operated in the loadable pattern and examining whether the bucket position is full crowd; and verifying whether the working state is the excavation completed state according to whether the current bucket position is the full crowd.

2. The method for controlling an automatic operation of a working unit of a wheel loader of claim 1, further comprising:

examining whether the current position of the driving direction operating lever is the backward-movement position;

recognizing that the current working state is the excavation completed state when the current bucket position is the full crowd after the verification process is performed; and examining whether a current position of the driving direction operating lever is the backward-movement position.

3. An apparatus for controlling an automatic operation of a working unit of a wheel loader, comprising:

an automatic operation selecting switch for selecting an automatic operation mode;

a driving direction operating lever detecting a driving direction command;

a working unit angle sensor detecting current positional states of a boom and a bucket;

a working unit controlling unit controlling motions by supplying hydraulic pressure to a boom and a bucket cylinder;

a driving device controlling unit controlling forward movement or backward movement of the wheel loader; and a control unit configured to detect a bucket position by using the working unit angle sensor, verify a working state of the wheel loader by using the driving direction operating lever to detect a driving state, examine whether a current driving direction operating lever position is a backward-movement position through the driving direction operating lever when the verified working state is an excavation completed state, the control unit configured to be triggered to implement an auto detent function by commanding to automatically move up a position of the boom up to a predetermined position with the working unit controlling unit together with backward driving of the wheel loader while the verified working state is the excavation completed state depending on whether the automatic operation mode is set when the driving direction operating lever position is the backward-movement position;

wherein the control unit is configured to examine whether the driving direction operating lever position is a forward-movement position, recognize that an operation for an excavation work is currently underway, as a current working state, when a bucket is operated in a loadable pattern after examining whether the bucket is operated in the loadable pattern by using the working unit angle sensor when the driving direction operating lever position is the forward-movement position, and recognize that the working state is the excavation completed state depending on whether the current bucket position is full crowd after examining whether the bucket position is the full crowd by using the working unit angle sensor, wherein the predetermined position is the predetermined position of the boom in order to perform the detent function which is a function to automatically stop upward and downward movements of the boom at a predetermined height; and wherein the control unit is further configured to examine whether a boom joystick is in a neutral position before backward driving, wherein if the boom joystick is in the neutral position, the control unit outputs a backward movement driving direction controlling command to the driving device controlling unit, and if the boom joystick is not in the neutral position indicating that a user is operating the boom joystick, then the control unit does not output the backward movement driving direction control command.

4. The apparatus for controlling an automatic operation of a working unit of a wheel loader of claim 3, wherein the control unit is configured to examine whether the boom is below the predetermined position of the boom in order to perform the detent function.

* * * * *

UNITED STATES PATENT AND TRADEMARK OFFICE

CERTIFICATE OF CORRECTION

PATENT NO. : 9,091,044 B2
APPLICATION NO. : 13/392316
DATED : July 28, 2015
INVENTOR(S) : Ki Hong Choi It is certified that error appears in the above-identified patent and that said Letters Patent is hereby corrected as shown below:

Title page

Item (57) Abstract, should read as follows:

Disclosed are an apparatus and method for controlling an automatic operation of a working unit of a wheel loader that control the automatic operation by estimating a subsequent operation according to a driving operation and a current state of the working unit. The method includes: verifying a working state of the wheel loader through detection of a bucket position and a driving state and examining whether the verified working state is an excavation completed state; examining whether a current position of a driving direction operating lever is a backward-movement position when the verified working state is the excavation completed state as a result of the examination; and automatically moving up a position of a boom up to a predetermined position together with backward driving of the wheel loader depending on whether an automatic operation mode is set when the driving direction operating lever position is the backward-movement position.

Signed and Sealed this
Second Day of February, 2016

Michelle K. Lee

Michelle K. Lee
*Director of the United States Patent and Trademark Office*